United States Patent [19]

Guttinger et al.

[11] Patent Number: 5,011,132

[45] Date of Patent: Apr. 30, 1991

[54] LOAD ACCUMULATOR HAVING POSITIVE DRIVE CONVEYOR

[76] Inventors: Peter Guttinger, 862 Cabot Trail, Milton, Canada, L9T 3S8; Marinus J. M. Langen, 21 Chilcot Avenue, Toronto, Ontariro, Canada, M9W 1T9

[21] Appl. No.: 530,197

[22] Filed: May 29, 1990

[51] Int. Cl.[5] ..... B65H 29/20

[52] U.S. Cl. ..... 271/315; 271/309; 271/269; 271/198; 198/347.2; 198/438; 198/370

[58] Field of Search ..... 271/187, 315, 198, 300, 271/309, 195, 269; 198/370, 372, 438, 360, 347.2, 733, 728, 484.1

[56] References Cited

U.S. PATENT DOCUMENTS 4,102,253 7/1978 Gannicott ..... 271/315 X
4,561,546 12/1985 Maroney ..... 198/728 X
4,835,947 6/1989 Langen et al. ..... 271/315 X
4,941,562 7/1990 Proepper et al. ..... 198/728 X

*Primary Examiner*—Joseph E. Valenza
*Assistant Examiner*—Keith L. Dixon
*Attorney, Agent, or Firm*—Fetherstonhaugh & Co.

[57] ABSTRACT

A load accumulator which has one or more stacking wheels mounted for high speed rotation is provided with an improved conveyor for conveying load items to the stacking wheel. The conveyor includes platforms that extend toward each stacking wheel in a plane located above the stacking wheel. An endless conveyor is mounted above the platforms and has a forward run that extends toward a discharge end from the platform which opens into a pocket of the transfer wheel. A plurality of load pushing fingers are mounted on the conveyor and project toward the platform. The fingers positively drive the load items along the platform and ensure that the load items are correctly positioned for entry into the pockets of the transfer wheel at high speed.

2 Claims, 2 Drawing Sheets

LOAD ACCUMULATOR HAVING POSITIVE DRIVE CONVEYOR

BACKGROUND OF THE INVENTION

This invention relates to load accumulators of the type that employ one or more stacking wheels of the type which have a plurality of spirally extending load receiving pockets. In particular, this invention relates to an improved conveyor mechanism for conveying load items to the stacking wheels.

As shown in U.S. Pat. Nos. 3,851,773 Kluge et al. and 4,120,491 Lang and 4,511,136 Yamada et al., it is common to use a conveyor system for conveying load items to stacking wheels which employs a pair of conveyor belts which have forward runs arranged in a face-to-face relationship. The load items are simply clamped between the belts and are driven to the transfer station by means of the frictional contact between the load items and the belts.

It will be noted that the open ends of the pockets of the stacking wheels are circumferentially spaced from one another at uniformly spaced intervals. Because the conveyor belt systems of the known devices rely on frictional contact, slippage can occur and, as a result, during a very high speed operation which the stacking wheels are designed to accommodate, difficulty is experienced in synchronizing the delivery of the load items on the conveyor with the position of the pockets of the stacking wheels.

I have found that this difficulty can be overcome by providing a conveyor system in which pushing members are provided at circumferentially spaced intervals along a conveyor system for positively pushing load items into the transfer station.

SUMMARY OF THE INVENTION

It is an object of the present invention to provide an improved conveyor mechanism for conveying load items to a rotary stacking wheel of a load accumulator.

It is a further object of the present invention to provide a conveyor mechanism which has pusher members arranged to positively push load items along the conveyor so as to provide for the positive synchronization of the load movement and the stacking wheel.

According to one aspect of the present invention there is provided in a load accumulator which has a stacking wheel mounted for high speed rotation, the stacking wheel having a plurality of spirally extending load receiving pockets which open tangentially therefrom at circumferentially spaced intervals and conveyor means for conveying load items one at a time to a transfer station in which the load items are transferred into a pocket of the stacking wheel, the improvement wherein said conveyor means comprises;

(a) a platform that extends toward the stacking wheel in a plane that extends above the stacking wheel, the platform having a discharge edge located in the transfer station in a transferred relationship with respect to the pockets of the stacking wheel, (b) an endless conveyor mounted above the platform and having a forward run located in close proximity to the platform and extending toward the discharge end of the platform, and (c) a plurality of load pushing fingers mounted on the endless conveyor and projecting outwardly therefrom so as to extend from the forward run toward the platform and be operable to provide a positive drive for pushing load items along the platform to and over the discharge edge.

DESCRIPTION OF THE PREFERRED EMBODIMENT

Figure 1:
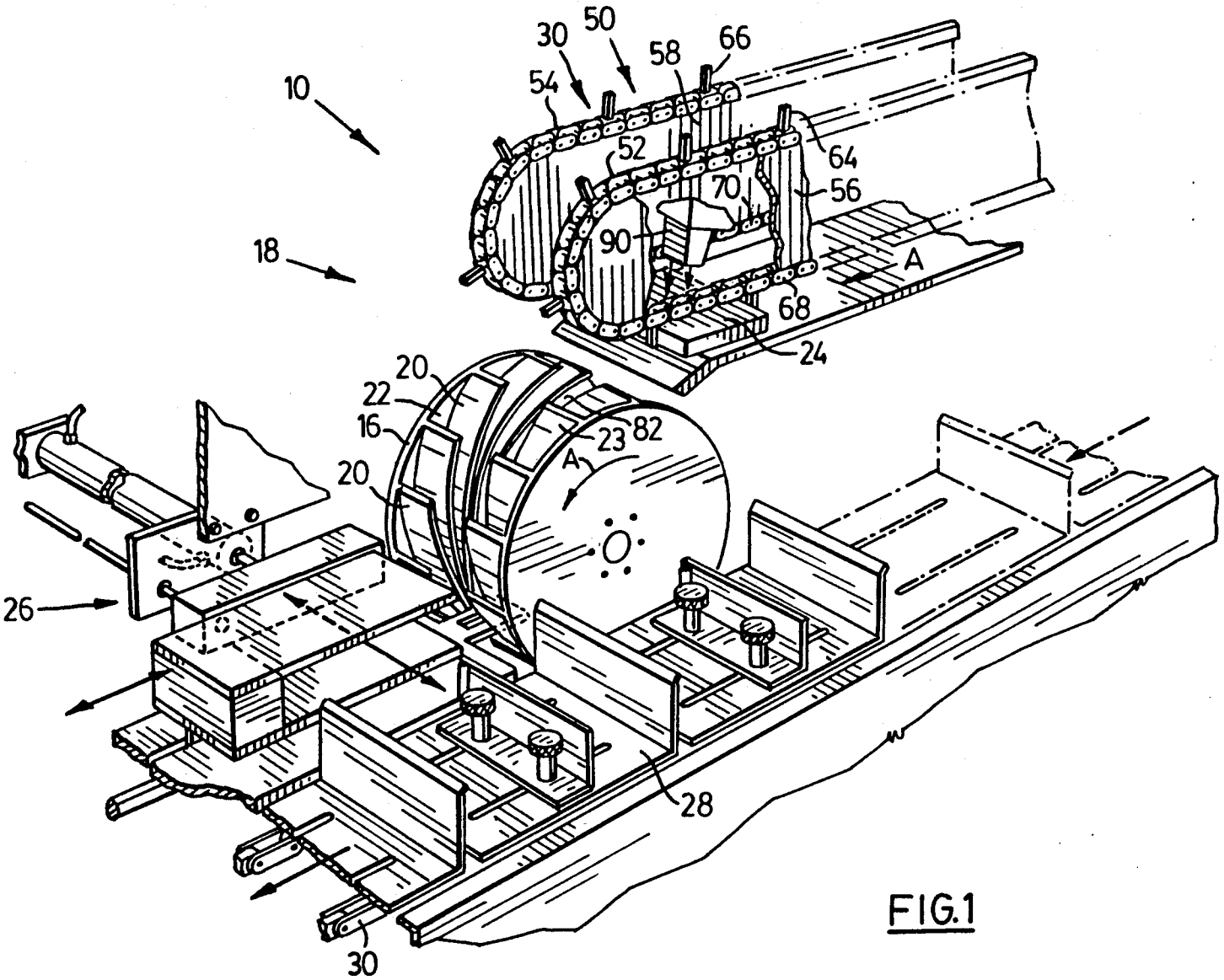
FIG. 1 is a pictorial view of a transfer station of a load accumulator constructed in accordance with an embodiment of the present invention.
Figure 2:
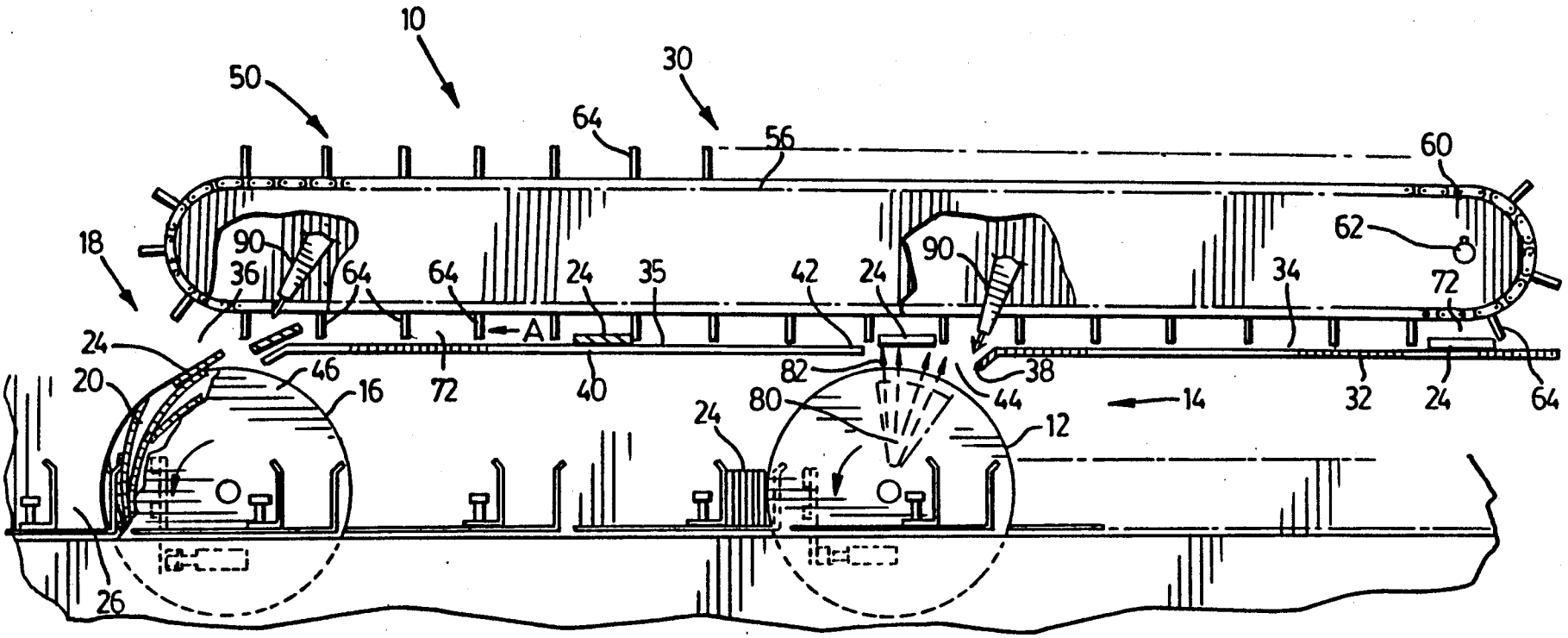
FIG. 2 is a side view of a load accumulator showing two load transfer stations.

With reference to FIGS. 1 and 2 of the drawings, the reference numeral 10 refers generally to a portion of a load accumulator mechanism constructed in accordance with an embodiment of the present invention. As shown in FIG. 2 of the drawings, the load accumulator has a first stacking wheel 12 located in a first transfer station 14 and a second stacking wheel 16 located in a second transfer station 18.

Each of the stacking wheels 12, 16 have a plurality of spirally extending load receiving pockets 20 which have an entranceway 22 that opens circumferentially at uniformly spaced intervals about the circumference of the stacking wheel.

Load items 24 are accumulated in a load accumulating station 26 and are loaded into load receiving compartments 28 of the conveyor 30 by a load accumulating mechanism of the type described in U.S. Pat. No. 4,835,947, dated June 6, 1989. This mechanism is described in detail in the applicant's prior application and will not therefore be described in detail in the present application.

A conveyor assembly 30 is provided for positively driving load items 24 into one or other of the transfer stations 14 and 18. The conveyor mechanism 30 includes a first platform 32 which has an upper surface 34 that extends in the first plane 36 that is located above the first and second stacking wheels 12 and 16. The first platform 32 has a discharge edge 38 located in the transfer station 14 in a transfer relationship with respect to the pockets of the first transfer wheel 12. A second platform 40 extends in the plane 36 and has a receiving edge 42 located opposite the discharge edge 38 of the first platform in a spaced relationship thereto so as to provide transfer passage 44 therebetween. The second platform 40 has a second discharge edge 46 located in the second transfer station 18 in a transfer relationship with respect to the pockets of the second transfer wheel 16. The conveyor mechanism 30 also includes a load transporting conveyor which is generally identified by the reference numeral 50. The conveyor 50 includes endless chains 52 and 54 which are mounted on support plates 56 and 58 respectively for movement in the direction of the arrow A. The chains 52 and 54 are mounted on driven sprockets 60 which are driven through power input shaft 62 from a power source (not shown). The sprockets 60 are keyed to the shaft 62 so that they are maintained in a fixed relationship with respect to one another and will operate to maintain a synchronized relationship between the chains 52 and 54. The chains 52 and 54 have a plurality of pushing fingers 64 and 66 located thereon at longitudinally spaced intervals. The pushing fingers 64 and 66 project outwardly from the chains 52 and 54 respectively. The chains 52 and 54 have forward run portions 68 and 70 respectively that extend in close proximity to the platforms 32 and 40 such that the outer ends of the pushing fingers 64 and 66 terminate in close proximity to the upper faces 34 and 35 of the platforms 32 and 40 respectively. Load transport compartments 72 are formed between adjacent sets of pushing fingers 62, 64 and are proportioned to accommodate load items 24.

In use, load items such as flexible pouches are loaded onto platform 32 so as to enter a compartment 72. A pushing finger 64 engages the load item 24 and pushes it along the platform 32 toward the transfer passage 44.

As shown in FIG. 2, the first transfer wheel 12 has an air nozzle 80 located centrally of the width thereof in the gap 82 (FIG. 1) formed between the vanes 23 of the wheel 12. The nozzle 80 has a plurality of orifices located along an arcuate path through which air streams 82 may be discharged. The air streams 82 are arranged to extend across the plane 36 and are operable to support the load item 24 as it is pushed by the fingers 64 across the transfer passage 44 onto the second platform 40. As shown at the left side of, FIG. 2, the pushing fingers 64 maintain contact with the load items 24 until the load items are discharged into a pocket 20. The load items 24 are removed from the wheel and are accumulated in the load accumulating station 26. When a sufficient number of load items 24 have been conveyed across the transfer passage 44, the supply of air to the nozzle 80 is interrupted and the air streams 82 no longer flow.

Air is then supplied to the nozzle 90 from which a stream of air is directed downwardly across the plane 36 toward the wheel 12. As a result, the next load item that is driven over the discharge edge 38 of the first platform will be deflected downwardly by the stream of air that is discharged from the nozzle 90 such that it is directed into a pocket of the first transfer wheel 12 and load items will continue to be supplied to the stacking wheel 12 until the predetermined number of load items required to provide the accumulated load have been accumulated. While the first stacking wheel is in operation, the load accumulated in the load accumulating station 26 of the second wheel 16 is transferred into a compartment 28. After the required load has been accumulated in the first accumulating station, the air supply to the nozzle 90 is interrupted and air is again supplied to the nozzle 80 to establish the air jets 82 and the process of accumulating the load in the second accumulating station is commenced.

From the foregoing it will be apparent that the movement of the pusher fingers 64 along the platforms 32 and 40 positively determines the position of the load items 24 yet, because the fingers 64 are mounted on a chain conveyor by the sprocket 60, the movement of the pusher fingers 16 can be closely synchronized with respect to the rotation of the stacking wheels 12 and 16. Because of the fact that it is possible to obtain this accurate synchronized movement it is also possible to operate the accumulating mechanism at very high speeds.

From the foregoing it will be apparent that the present invention provides a simple and efficient load accumulating mechanism which permits high speed operation.

I claim:

1. In a load accumulator which has a stacking wheel mounted for high speed rotation, the stacking wheel having a plurality of spirally extending load receiving pockets which open tangentially therefrom at circumferentially spaced intervals and conveyor means for conveying load items one at a time to a transfer station in which the load items are transferred into a pocket of the stacking wheel, the improvement wherein said conveyor means comprises;

(a) a platform that extends toward the stacking wheel in a plane that extends above the stacking wheel, the platform having a discharge edge located in the transfer station in a transferred relationship with respect to the pockets of the stacking wheel, (b) an endless conveyor mounted above the platform and having a forward run located in close proximity to the platform and extending toward the discharge end of the platform, and (c) a plurality of load pushing fingers mounted on the endless conveyor and projecting outwardly therefrom so as to extend from the forward run toward the platform and be operable to provide a positive drive for pushing load items along the platform to and over the discharge edge.

2. In a load accumulator which has first and second stacking wheels mounted for high speed rotation in first and second transfer stations that are spaced from one another, the stacking wheels each having a plurality of spirally wound load receiving pockets which open tangentially therefrom at circumferentially spaced intervals and conveyor means for conveying load items one at a time to one or other of such stacking wheels, the improvement wherein said conveyor means comprises;

(a) a first platform that extends toward the first stacking wheel in a plane that extends above the first stacking wheel, the first platform having a first discharge edge located in the first transfer station in a transfer relationship with respect to the pockets of the first stacking wheel, (b) a second platform that extends between the first stacking wheel and the second stacking wheel in said plane, said second platform having a receiving edge disposed opposite and spaced from the first discharge edge of the first platform, said second platform having a second discharge edge located in said second discharge station in a transfer relationship with respect to the pockets of the second stationary wheel, (c) an endless conveyor mounted above the first and second platforms and having a forward run that extends through the first transfer station to the second discharge edge in the second transfer station, (d) a plurality of load pushing fingers mounted on the endless conveyor projecting outwardly therefrom so as to extend from the forward run toward the platform and being operable to provide a positive drive for pushing load items along said platform, (e) air jet means in said first transfer station which is operable to direct a stream of air upwardly from below said platforms between said first discharge edge and said receiving edge, to support load items in said plane as they are pushed through said first transfer station to permit the load items to be accumulated in the second stacking wheel, said air jet means being capable of being deactivated to permit the load items to be discharged from the discharge edge of the first platform to the first transfer wheel.

* * * * *